US005256990A

United States Patent [19]

Young

[11] Patent Number: 5,256,990

[45] Date of Patent: Oct. 26, 1993

[54] COMPACT, DIE-CAST PRECISION BANDSTOP FILTER STRUCTURE

[75] Inventor: Lock R. Young, Palm Bay, Fla.

[73] Assignee: Skydata, Inc., Melbourne, Fla.

[21] Appl. No.: 880,900

[22] Filed: May 8, 1992

[51] Int. Cl.[5] ..... H01P 1/207; H01P 1/209

[52] U.S. Cl. ..... 333/208; 333/209

[58] Field of Search ..... 333/202, 208-212, 333/227, 231, 233, 239, 248, 253

[56] References Cited

U.S. PATENT DOCUMENTS

| | | | |
|---|---|---|---|
| 3,949,327 | 4/1976 | Chapell | 333/208 X |
| 4,752,753 | 6/1988 | Collins et al. | 333/209 |

FOREIGN PATENT DOCUMENTS

| | | | |
|---|---|---|---|
| 0226951 | 7/1987 | European Pat. Off. | 333/212 |
| 0078601 | 4/1988 | Japan | 333/210 |
| 1465962 | 3/1977 | United Kingdom | 333/208 |

*Primary Examiner*—Robert J. Pascal
*Assistant Examiner*—Seung Ham
*Attorney, Agent, or Firm*—Charles E. Wands

[57] ABSTRACT

A precision, waveguide-configured, bandstop filter comprises a substrate formed of a conductive material capable of being die cast. To facilitate manufacture and assembly, the substrate is preferably formed as a pair of symmetrically shaped substrate halves which, when mated together, define an interior filter structure that performs the required bandstop filter function. Each substrate half is configured to have a generally longitudinal slot that extends from a planar mating surface and effectively forms one half of an interior longitudinal waveguide section through the filter. Transverse to and located at spaced apart locations along the longitudinal slot are a plurality of channels, which define parallel conductive surface webs that extend from opposite sidewalls of the longitudinal slot. The channels serve as distributed, diametrically opposed pairs of lumped parameter tuning elements of the bandstop filter. A first end of each web forms a portion of a conductive sidewall of the longitudinal slot. Adjacent ones of the first ends of the webs are spaced apart from one another by land portions therebetween, the land portions forming part of the conductive sidewalls of the longitudinal slot. Each land portion has an opening which forms an iris that couples electromagnetic energy from the longitudinal waveguide slot into a respective channel. Each channel terminates at a conductive end thereof that is spaced apart from a respective land portion in which an iris is formed by a distance on the order of one-half the wavelength of the frequency to be excised.

11 Claims, 4 Drawing Sheets

COMPACT, DIE-CAST PRECISION BANDSTOP FILTER STRUCTURE

FIELD OF THE INVENTION

The present invention relates in general to electromagnetic energy coupling devices and to the manufacture thereof, and is particularly directed to a compact, precision waveguide-configured bandstop filter architecture which facilitates prototype design and assembly, so that the filter may be readily die cast, thereby significantly reducing its cost of manufacture as compared with conventional electro-formed 'exact design' bandstop filter structures.

BACKGROUND OF THE INVENTION

Microwave bandstop filter structures, such as those employed for multi-port antenna feeds, have conventionally been constructed using custom or precision designs, or by using approximate waveguide-configured structures. While conventional exact design filter structures can meet both performance and reduced volume packaging objectives, their extremely narrow dimensional tolerances require that the filters be electroformed, which considerably increases the cost of manufacture. Larger waveguide-configured structures, on the other hand, are less expensive to manufacture but, because of their size, usually do not meet packaging requirements of the associated antenna system.

More particularly, as diagrammatically illustrated in FIG. 1, a compact precision design bandstop filter is typically formed by electroplating a metal, usually copper, although nickel is sometimes employed, onto a mandrel. The mandrel is preconfigured to provide a plurality of successive, diametrically opposed pairs of generally rectangularly shaped lumped bandstop filter elements or E-plane shorted stubs 11, which effectively function as a distributed series of varying impedances along a longitudinal waveguide-configured section 13. Each diametrically opposed pair of E-plane rectangular waveguide segments, or shorted stubs, is oriented transverse to the longitudinal waveguide section and has an effective electrical length of one-quarter wavelength of a prescribed frequency to be excised from a band of signals over which the filter structure is intended to operate.

As one traverses the length of the longitudinal waveguide section, the pairs of stubs, which are spaced an odd number of quarter wavelengths apart, vary in impedance level, as do the longitudinal waveguide sections. The impedances of the stubs generally decrease from the center of the filter structure to the outer edges and their cross-sections or widths W become narrower. In terms of a practical design for a narrow band Ku band filter, it is not uncommon for the widths of the narrower E-plane stubs to be on the order of fifteen to twenty mils. With a stub aspect ratio on the order of ten-to-one (associated with the required quarter-wavelength depth of the E-plane short), producing a filter structure having E-plane stubs of such dimensions have been achieved only by electro-forming the filter on a preshaped mandrel.

The high cost of precision electro-forming constitutes a significant impediment to the proliferation of a wide variety of small aperture earth terminals in today's satellite communication environment, where minimizing component cost and maintenance expenses are principal motivators to the system designer. Not only do electroformed components cost more to manufacture, but because the metal employed (e.g. the above-referenced copper or nickel) to electro-form such parts is not the same as that of most of the remaining hardware components of the system, particularly waveguide sections made of aluminum, there is often a metallic mismatch at the joints between an electro-formed part and the electromagnetic energy 'plumbing' to which the part is connected, which subjects the hardware to potential 'mechanical insertion loss' over a period of use.

In a larger, waveguide-configured structure, such as that diagrammatically shown in FIG. 2 (which corresponds generally to FIG. 12.01-1(*b*) of the text by G. L. Matthaei et al, entitled "Microwave Filters, Impedance-Matching Networks, and Coupling Structures," published by McGraw-Hill Book Co., 1964), a plurality of generally rectangularly shaped lumped bandstop filter elements 21 are individually distributed along a longitudinal section of rectangular waveguide 23. Each bandstop filter element 21 comprises a respective E-plane waveguide segment or stub, oriented transverse to the axis of the longitudinal waveguide section and having an effective electrical length L of one-half wavelength of a prescribed frequency to be excised from a prescribed band of signals with which the filter structure is intended to operate.

In order to prevent adjacent filter elements from interacting with one another, the bandstop filter elements 21 are spaced apart from one another along the waveguide section 23 at successive intervals corresponding to three-quarters of the wavelength of the center frequency of the filter's operational bandwidth, which implies a relatively large lengthwise dimension of the filter. In such a waveguide-configured structure, each half-wavelength waveguide E-plane segment is electromagnetically coupled to the longitudinal waveguide section by way of an aperture or iris 25 formed in a broadwall of the longitudinal waveguide section 23. The sizes of the irises are tailored to adjust the effective impedances of the stubs to approximate the performance of the exact design of FIG. 1. The ends 27 of the lumped elements 21 comprise conductive walls which effectively provide a shorted termination for each filter element.

Now, although the waveguide-configured bandstop filter architecture of FIG. 2 is less expensive to manufacture than the electro-formed configuration of FIG. 1, its substantial size (overall physical length) makes this structure unsuitable for current compact packaging requirements.

SUMMARY OF THE INVENTION

Pursuant to the present invention, there is provided a new and improved bandstop filter architecture, which provides the precision performance and compact hardware features of the exact, electro-formed design of the filter of FIG. 1, yet its dimensions are such that it is capable of being die cast, thereby making it significantly less expensive to manufacture than an electro-formed design. In this sense it enjoys the cost reduction attributes of the waveguide structure of FIG. 2.

In accordance with an embodiment of the improved bandstop filter of the present invention, the filter comprises a substrate formed of a material (such as brass, copper, aluminum) that is both conductive and readily lends itself to being die cast. To facilitate manufacture and assembly, the substrate is preferably formed as a pair of symmetrically shaped substrate halves which, when mated together, define an interior filter structure that performs the required bandstop filter function.

Each substrate half is configured to have a generally longitudinal waveguide slot that extends from a first, generally planar mating surface and effectively forms one half of an interior longitudinal waveguide section through the filter. Transverse to and located at spaced apart locations along the longitudinal slot, are one or more, usually a plurality of, diametrically opposed pairs of grooves or channels. These channels define first and second sets of diametrically opposed sets of parallel conductive surface webs that extend from opposite sidewalls of the longitudinal slot. The channels serve as distributed, diametrically opposed pairs of lumped parameter tuning elements of the bandstop filter.

A first, interior end of each of the webs forms a portion of a conductive sidewall of the longitudinal slot. Adjacent ones of the first, interior ends of the webs are spaced apart from one another by land portions therebetween, the land portions forming part of the conductive sidewalls of the longitudinal slot and having sufficient mechanical strength and thickness to facilitate handling and iris forming (e.g. machining). In each land portion an opening or iris is formed so as to couple electromagnetic energy from the longitudinal slot or waveguide section into a respective channel (bandstop tuning element). Each channel terminates at a conductive end thereof that is spaced apart from a respective land portion in which an iris is formed by a distance on the order of one-half the wavelength of the frequency to be excised, as defined by the size of the iris.

In order to define the shape of a form for die-casting each substrate half, a filter prototype structure is initially shaped and assembled. For this purpose, first and second machinable, conductive (e.g. brass) blocks, each of which has a generally planar surface, are provided. In each brass block, a generally longitudinal slot is formed, the slot extending from the generally planar surface to a prescribed depth in the block.

Next, one or more, and typically a plurality of parallel channels are formed (e.g. machined) in the planar surface of each block, so as to be transverse to and intersect spaced apart locations of the longitudinal slot. Where the filter is to comprise a plurality of tuning elements, a corresponding plurality of such channels define therebetween first and second sets of parallel conductive webs, respective interior surfaces of which are disposed on opposite sides of and transverse to the longitudinal slot.

To delineate the interior sidewall configuration of the longitudinal waveguide section of the filter, the prototype filter assembly further includes a pair of machineable, conductive (e.g. brass) plates. A plurality of parallel recesses are formed in one surface of each plate, such that adjacent ones of the recesses are spaced apart from one another by land portions therebetween. The recesses in each plate are sized to engage one of the sets of parallel conductive webs in a brass block, when the plate is placed into one side of the longitudinal slot so as to abut against the webs.

With the plates mounted and soldered in place along opposite sides of the slot, rectangular openings or irises are cut into the land portions of the plates. Each iris is sized in accordance with the bandwidth associated with that lumped element. Each channel is terminated by means of a conductive element (shorted stub) that is spaced apart from its associated iris by a distance on the order of half-wavelength of the frequency associated with that element.

The two brass blocks, with their respective iris plates and tuning stubs installed, are then joined together at their mating surfaces, to complete the prototype assembly. The performance of the bandstop filter structure is then measured, and the dimensions of the irises and the locations of the shorted stubs in the channels are adjusted as necessary in accordance with the intended operational parameters of the filter. After the overall interior dimensions of the filter structure have been established, the dimensions are used to shape a mold for die casting a pair of aluminum blocks, the interior shapes of which replicate those of the prototype, whereby assembling the die cast halves will produce the desired waveguide structure.

DETAILED DESCRIPTION

Figure 3:
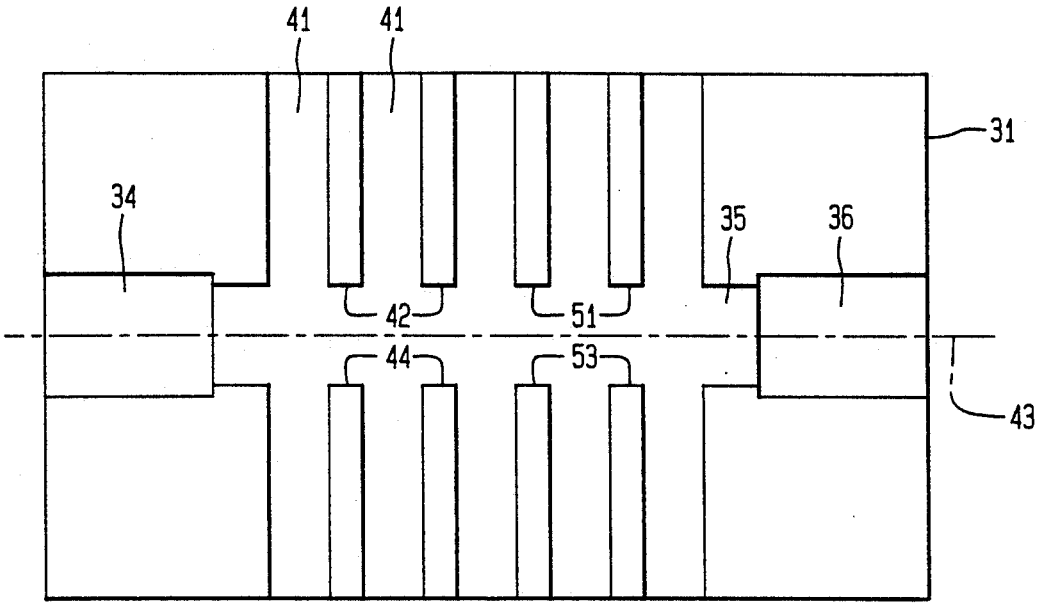
FIGS. 3, 4 and 5 are respective diagrammatic top, side and end views of one half of a prototype assembly used to define the shape of a form for die-casting a precision, waveguide-configured bandstop filter structure in accordance with the present invention.
Figure 4:
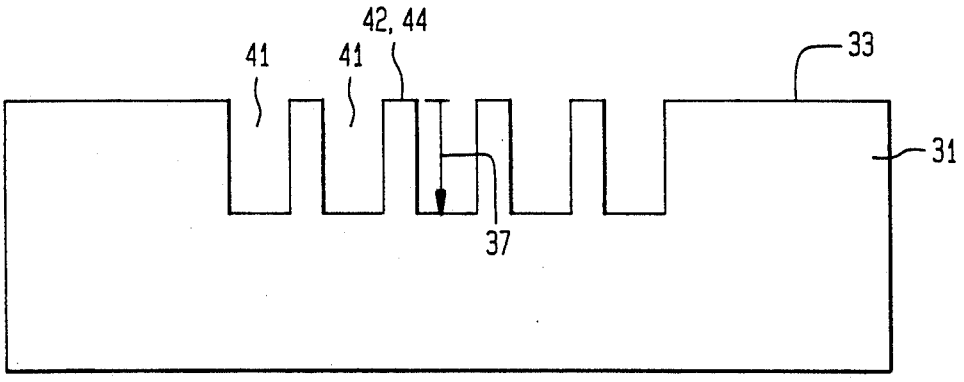
Figure 5:
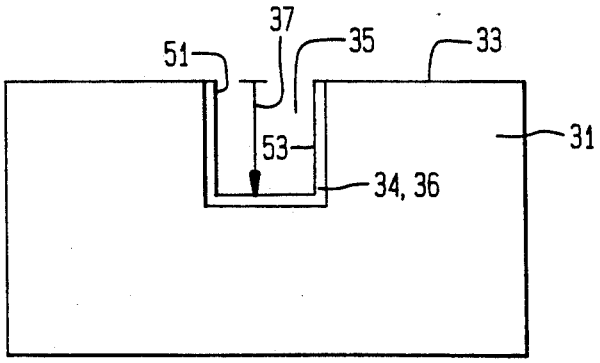

Referring now to FIGS. 3, 4 and 5, there are shown respective top and side views of one half of a prototype assembly used to define the shape of a form for die-casting a precision, waveguide-configured bandstop filter structure in accordance with the present invention. Specifically, each half of the prototype assembly comprises a machinable conductive substrate 31, such as a generally rectangular block of brass, having a planar surface top surface 33, which is intended to mate flush with the top surface of the other half of the prototype assembly. In each brass block or substrate half, for a rectangular cross-section waveguide filter, a generally longitudinal slot 35 of rectangular cross section is formed, for example, machined into the top surface of the block, so that it extends from planar surface 33 to a prescribed depth 37 in the brass block or substrate 31. Where appropriate, one or each opposite end of longitudinal slot 35 may have a respective transformer step portion 34, 36 to provide impedance matching to an adjacent waveguide element (not shown).

Next, at least one and usually a plurality of parallel rectangular cross-section channels or grooves 41 are formed (e.g. machined), into the planar surface 33 of the brass block, such that the channels are transverse to and intersect longitudinal slot 35 at successive locations along the longitudinal axis 43 of slot 35, spaced apart by one-quarter wavelength of the center frequency of the stop band. The depths of the channels 41 normally correspond to the depth of longitudinal slot 35 and the channels define therebetween first and second sets of parallel conductive webs 42, 44, respective interior surfaces 51, 53 of which form opposing sidewalls of longitudinal slot 35.

As pointed out previously, coupling electromagnetic energy from longitudinal waveguide slot 35 into a bandstop filter element is accomplished by way of an iris in the sidewall of the waveguide section. The iris of a respective tuning stub has a size that is dimensioned in accordance with the operational parameters of the filter, so that the effective combined impedance of the diametrically opposed, but structurally and electrically identical pair of stubs will reflect the required design impedance. With the opposed but identical stub pairs, the first higher order mode generated by the structure is the $TE_{12}/TM_{12}$ mode pair, due to the symmetry of the junction. For the typical filter structure of FIG. 2, the first higher mode generated by the structure is the $TE_{11}/TM_{11}$ mode pair or the second higher order mode in typical rectangular waveguide. The $TE_{12}/TM_{12}$ mode pair is approximately the 12th higher order mode in typical rectangular waveguide. The loss per unit length of a 'non-propagating' mode in waveguide beyond cutoff is a function of its cutoff frequency with respect to the frequency being used. Here, the loss per unit length for the symmetrical filter junction is extremely high. For example, for the present filter the loss between stub pairs with one-quarter wavelength spacings is about 53 dB at the stop band center frequency, whereas for the prior art type filter the loss is about 24 dB for one-quarter wavelength spacings. For a filter that must yield high rejection the coupling between the stubs due to higher order modes must also be high, and in the prior art this meant three-quarter wavelength spacing for the stubs, as illustrated in FIG. 2.

Figure 6:
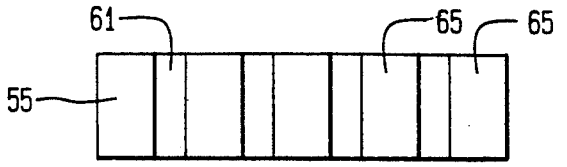
FIGS. 6 and 7 are respective top and side views of a sidewall plate having a plurality of parallel recesses formed to a predetermined depth in a first surface of the plate.
Figure 7:
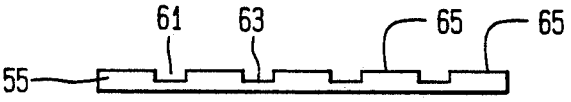

In order to form the irises for each of the filter channels or grooves and thereby delineate the interior sidewall configuration of the longitudinal waveguide section of the filter, a pair of relatively thin, machineable, conductive (e.g. brass) plates 55, an individual one of which is shown in FIGS. 6 and 7, is employed. By relatively thin is meant that each plate has sufficient thickness to give it mechanical strength and permit it to fit within longitudinal waveguide slot 35 for the purpose of defining the width-wise dimension of the slot, while still being able to be handled and machined into a multiple iris-containing element, through which electromagnetic energy coupling from the longitudinal waveguide slot into the bandstop filter elements is accomplished.

Figure 2:
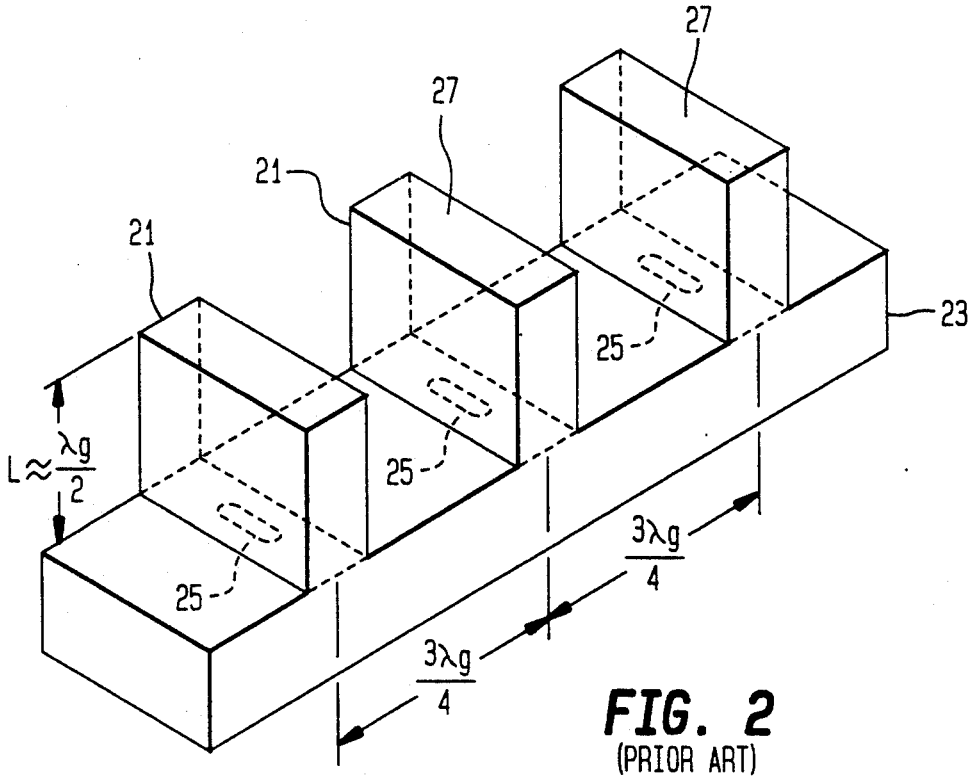
FIG. 2 (PRIOR ART)
FIG. 2 is a diagrammatic illustration of a conventional waveguide-configured bandstop filter structure.

As noted above, because of the use of pairs of symmetrically arranged, diametrically opposed tuning stubs, rather than waveguide axial separation, to obtain mode suppression, the spacing between successive filter sections (channels in block 31) can be reduced to one-quarter wavelength or one-third less than the three-quarter wavelength mechanism of the waveguide filter design of FIG. 2. Thus, the filter configuration of the present invention is relatively compact, making it compatible with current compact hardware packaging requirements.

Figure 1:
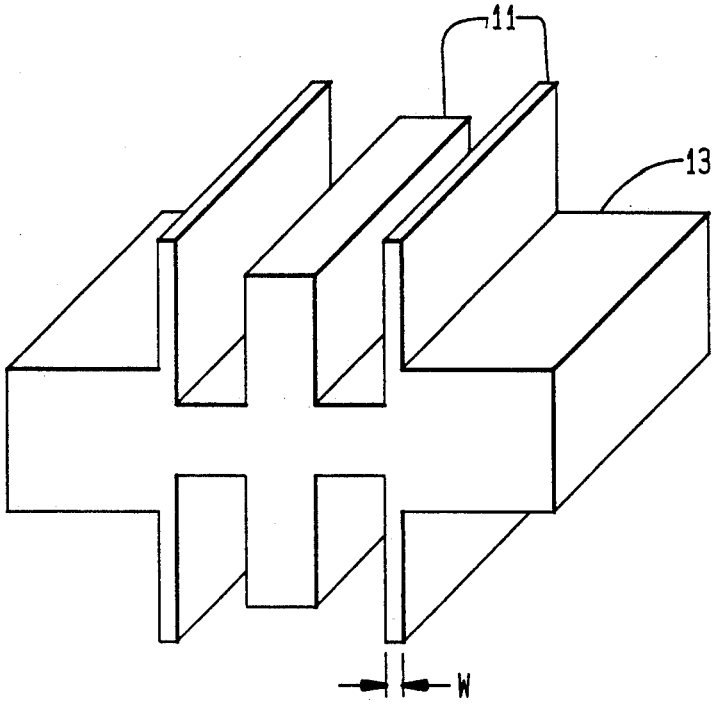
FIG. 1 (PRIOR ART)
FIG. 1 diagrammatically illustrates exact design, electro-formed bandstop filter.
Figure 8:
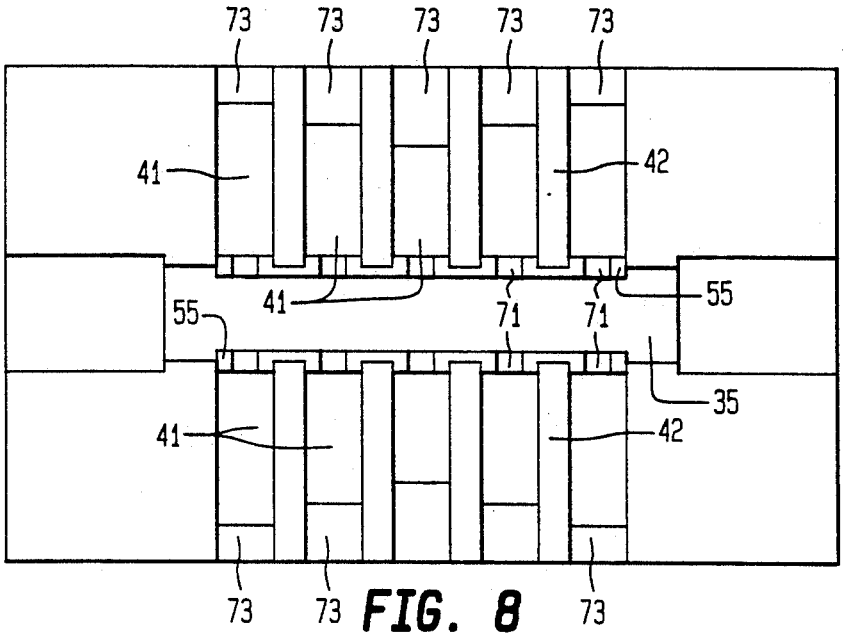
FIGS. 8, 9 and 10 are respective top, side and end views showing the block of FIGS. 3, 4 and 5 with a pair of the sidewall plates of FIGS. 6 and 7 installed in the longitudinal waveguide slot.
Figure 9:
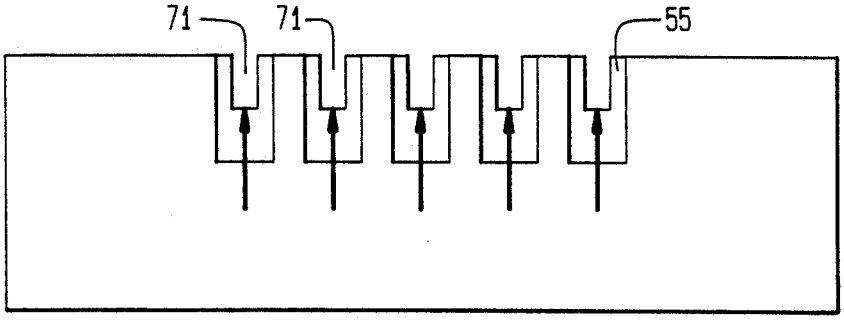
Figure 10:
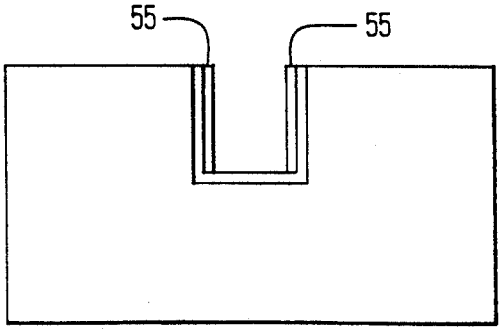

As illustrated in FIGS. 6 and 7, a plurality of parallel recesses 61 are formed to a predetermined depth 63 in a first surface 65 of each conductive plate 55, such that adjacent ones of the recesses 61 are spaced apart from one another by land portions 65 therebetween. The recesses in each plate are sized and dimensioned such that the respective recesses of a plate may receive and be fitted with one of the sets of parallel conductive webs 42, 44 in a brass block, when the plate 55 is placed into one side of the longitudinal slot 35, so as to abut against the webs, as shown in FIGS. 8, 9 and 1. With each plate 55 soldered in place along opposite sides of the slot, rectangular openings or irises 71 are individually formed (e.g. precision cut or machined) into the land portions of the plates 55.

Each pair of irises is sized in accordance with the intended impedance associated with that lumped element. Using conventional waveguide filter equations, such as those described in the above-referenced text, the dimensions of the irises of the filter elements may be calculated to a rough approximation. It is then a matter of trial and error refinement to eventually arrive at the precise values of the parameters of the interior size and shape of a respective filter segment. It has been found that placing a respective plate 55 into abutting engagement with the ends of one of the sets of webs 42, 44 facilitates formation of the irises in that plate, as contrasted with attempting to machine the irises in the plates before inserting the plates into the slot.

It is to be recalled that the present description addresses the formation and assembly of a prototype the final dimensions of which are to be used to define the size and shape of the mold to be employed in a die casting process. Once the irises 71 have been formed in the land portions 65 of each plate, the final dimension (i.e. the depth) of the filter element is established by means of a conductive element (shorted stub) 73 that is spaced apart from its associated iris by a distance on the order of half-wavelength of the frequency associated with filter element. The channel-terminating conductive stub may comprise an aluminum plug that may be threaded onto an adjustment screw (not shown) retained in tapped bore through an outerwall plate at the outer extremity of block 31.

The two conductive substrate or block halves are then joined together at their mating surfaces 33, to complete the prototype assembly. The performance of the bandstop filter structure is measured, and the dimensions of the irises 71 and the locations of the shorted stubs 73 in the channels 41 are adjusted as necessary in accordance with the intended operational parameters of the filter. After the overall interior dimensions of the prototype filter structure have been established by iterative measurements and adjustments to the iris openings and positioning of the channel shorted stubs, the dimensions of each half of the prototype structure are used to replicate a respective die casting form for that half.

Figure 11:
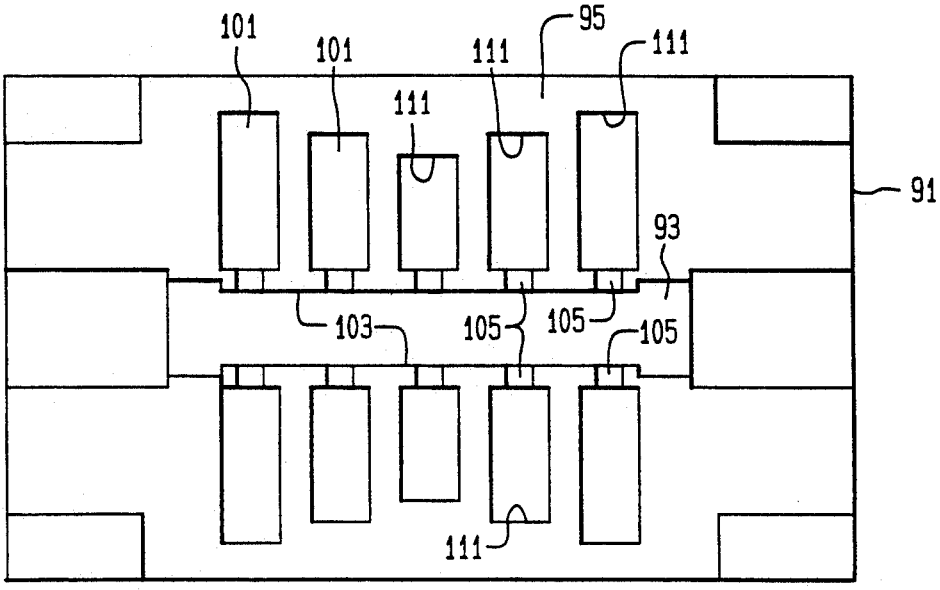
FIGS. 11, 12 and 13 are respective top, side and end views of a die-cast precision waveguide bandstop filter half.
Figure 12:
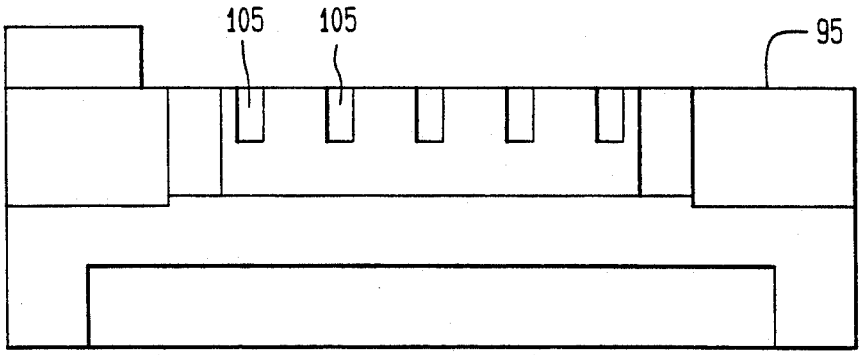
Figure 13:
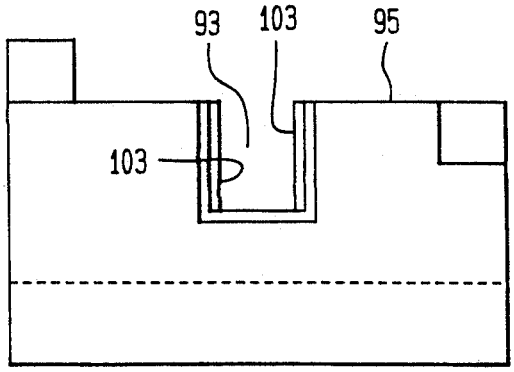

A respective aluminum block, the contoured shape of which replicates the dimensions of a prototype substrate, may then be die cast for each half of the original prototype assembly. The die cast halves are then assembled in a face-to-face abutting configuration to produce the desired waveguide bandstop filter structure. Namely, as shown in FIGS. 11, 12 and 13, each die-cast substrate half 91 will have a longitudinal waveguide slot 93 that extends from a first, generally planar mating surface 95 and effectively forms one half of an interior longitudinal waveguide section through the filter. Transverse to and located at spaced apart locations along the longitudinal slot, are a plurality of diametrically opposed pairs of filter element channels 101, which correspond to the channels 41 in the prototype. Each land portion 103 of the waveguide sidewall at the interior end of a channel 101 has an iris 105 that couples electromagnetic energy from the longitudinal waveguide slot 93 into a respective bandstop tuning element. Each channel terminates at a conductive endwall 111 that is spaced apart from a respective land portion 103 by a distance on the order of one-half wavelength of the frequency to be excised.

As will be appreciated from the foregoing description, the high manufacturing cost drawbacks of conventional precision, electro-formed bandstop filter designs and the size limitations of conventional waveguide-configured bandstop filter structures are effectively obviated by the precision waveguide-configured bandstop filter in accordance with the present invention, which is capable of being die cast from the same metal employed for the majority of waveguide-based components, thereby significantly reducing its cost of manufacture and making the filter architecture metallurgically compatible with system components to which it is connected. By prototyping the waveguide filter structure as a pair of machinable brass block assemblies, it is a straightforward exercise to dimension a mold for die casting two matching filter halves.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A method of forming an electromagnetic energy bandstop filter structure comprising the steps of:

(a) providing first and second conductive substrates, each of which has a first generally planar surface;

(b) in each of said substrates, (b1) forming a generally longitudinal slot which extends from said first surface to a prescribed depth in the substrate, (b2) forming a plurality of channels which are transverse to and intersect spaced apart locations of said generally longitudinal slot, thereby defining a first and second sets of parallel conductive substrate webs, respective interior surfaces of which are disposed on opposite sides of and transverse to said generally longitudinal slot, (b3) providing first and second conductive plates, each of which has a plurality of parallel recesses, adjacent ones of which are spaced apart from one another by land portions therebetween, said recesses being sized to engage one of said sets of parallel conductive webs, and wherein each of said land portions has an opening therethrough, (b4) affixing said first and second conductive plates within said slot such that the recesses of a respective plate receives and abuts against a respective set of webs, whereby the openings through the land portions of s id plates define respective irises from said slot into said channels, and (b5) providing, in each of said channels, a conductive element that is spaced apart from the iris thereof; and (c) joining said first and second conductive substrates together at the first surfaces thereof.

2. A method according to claim 1, further including the steps of:

(d) adjusting, as necessary, the dimensions of said irises and the locations of said conductive elements in said channels, in accordance with prescribed operational parameters of said bandstop filter structure, so as to define the overall interior dimensions of said filter structure; and (e) forming, from conductive material, a bandstop filter structure, the interior configuration of which effectively replicates that of the filter structure obtained in step (d).

3. A method according to claim 2, wherein step (e) comprises die casting a bandstop filter structure, the interior configuration of which effectively replicates that of the filter structure obtained in step (d).

4. A bandstop filter structure comprising a substrate at least the interior surfaces of which are conductive, said substrate having a generally longitudinal slot therethrough, a plurality of channels which are transverse to and located at spaced apart locations of said generally longitudinal slot, thereby defining therebetween first and second sets of spaced parallel conductive surface webs extending from opposite sidewalls of said generally longitudinal slot, a first, interior end of each of said webs forming a portion of a conductive sidewall of said generally longitudinal slot, and wherein adjacent ones of the first, interior ends of said webs are spaced apart from one another by land portions therebetween, said land portions forming part of the conductive sidewalls of said generally longitudinal slot, and wherein each of said land portions has an opening therethrough which forms an iris that couples electromagnetic energy from said generally longitudinal slot into a respective transverse channel, and wherein each of said channels terminates at a conductive end thereof spaced apart from a respective land portion in which an iris if formed, and wherein said channels are distributed along said longitudinal slot at a spacing corresponding to one-quarter wavelength of the stopband center frequency.

5. A bandstop filter structure according to claim 4, wherein said substrate is formed of a plurality of mated conductive members.

6. A bandstop filter structure according to claim 4, wherein substrate comprises a conductive substrate.

7. A bandstop filter element comprising a conductive substrate having a first, generally planar surface, a generally longitudinal slot extending therethrough from said first surface, a plurality of channels extending from said first surface transverse to and located at spaced apart locations of said generally longitudinal slot, thereby defining therebetween first and second sets of spaced parallel conductive surface webs extending from opposite sidewalls of said generally longitudinal slot, a first, interior end of each of said webs forming a portion of a conductive sidewall of said generally longitudinal slot, and wherein adjacent ones of the first, interior ends of said webs are spaced apart from one another by land portions therebetween, said land portions forming part of the conductive sidewalls of said generally longitudinal slot, and wherein each of said land portions has an opening extending from said first surface which forms a portion of an iris to be used to couple electromagnetic energy from said generally longitudinal slot into a respective transverse channel, and wherein each of said channels terminates at a conductive end thereof spaced apart from a respective land portion in which an iris is formed.

8. A bandstop filter element comprising a plurality of bandstop filter elements according to claim 7, mated together at the first surfaces thereof.

9. A bandstop filter element according to claim 7, wherein said channels are distributed along said longitudinal slot at a spacing corresponding to one-quarter wavelength of the stopband center frequency.

10. A bandstop filter structure comprising a conductive substrate having a generally longitudinal waveguide slot therethrough, a plurality of bandstop tuning channels which are transverse to and located at spaced apart locations of said generally longitudinal slot, thereby defining therebetween first and second sets of spaced parallel conductive surface webs extending from opposite sidewalls of said generally longitudinal slot, a first, interior end of each of said webs forming a portion of a conductive sidewall of said generally longitudinal waveguide slot, and wherein adjacent ones of the first, interior ends of said webs are spaced apart from one another by land portions therebetween, said land portions forming part of the conductive sidewalls of said generally longitudinal waveguide slot, and wherein each of said land portions has an opening therethrough which forms an iris that couples electromagnetic energy from said generally longitudinal waveguide slot into a respective transverse bandstop tuning channel, and wherein each of said bandstop tuning channels terminates at a conductive end thereof spaced apart from a respective land portion in which an iris is formed, and wherein said channels are distributed along said longitudinal slot at a spacing corresponding to one-quarter wavelength of the stopband center frequency.

11. A bandstop filter structure according to claim 10, wherein said substrate is formed of a plurality of mated conductive members.

* * * * *